United States Patent [19]

Hansberg

[11] 4,054,172

[45] Oct. 18, 1977

[54] DEVICE FOR THE PRODUCTION OF CASTINGS

[76] Inventor: Julius Hansberg, Via Bellinzona 31/2, Modena, Italy

[21] Appl. No.: 682,353

[22] Filed: Apr. 30, 1976

[30] Foreign Application Priority Data

Apr. 30, 1975 Italy ..... 22920/75

[51] Int. Cl.[2] ..... B22D 47/02

[52] U.S. Cl. ..... 164/168; 164/167; 164/324

[58] Field of Search ..... 164/130, 322, 323, 324, 164/329, 330, 331, 167, 168

[56] References Cited

U.S. PATENT DOCUMENTS

| | | | |
|---|---|---|---|
| 3,029,482 | 4/1962 | Burnett | 164/324 |
| 3,955,613 | 5/1976 | Lund | 164/130 |

FOREIGN PATENT DOCUMENTS

| | | | |
|---|---|---|---|
| 318,251 | 2/1957 | Switzerland | 164/324 |

*Primary Examiner*—Robert D. Baldwin
*Attorney, Agent, or Firm*—Karl W. Flocks

[57] ABSTRACT

An improved method for the production of castings is disclosed, according to which the flasks are stripped from the sand moulds subsequently to pouring the molten metal in the moulds and the initial cooling of the castings, the flasks are directly forwarded to a moulding machine, the stripped moulds with the castings held therein being forwarded along a longer cooling path on a rotating guide. The implementation is composed by two straight conveying paths connected at the respective ends by a semicircular path along the straight guide sections the stripping machines and the moulding machines are arranged.

6 Claims, 3 Drawing Figures

DEVICE FOR THE PRODUCTION OF CASTINGS

The invention relates to an apparatus for the production of castings by moulding, melting, cooling and stripping of the mould on a rotary guide by means of flasks.

In the conventional installations for the moulding, melting and cooling of castings, the flasks with the forming material and the castings are led on a secondary guideway to have the castings cooled thereon. After cooling, they reach a vibratory grid which separates the flasks from the forming material and the castings. Subsequently, or at a later stage, the flasks are led again to a longer conveyance route of the moulding machine. This approach has the drawback that, besides a high first cost for a particularly branched guideway and for the conveyance devices which are thus required, a high number of flasks becomes necessary.

It has also been suggested to strip the flasks prematurely from the sand matrix and the casting which has been only partially cooled and to deflect the sand matrix with the casting on a separate guideway. The passage of the sand matrix with the casting on a further guide has, besides the first cost which is thus necessary, the defect that the separation of the flasks and the sand matrix can take place only after that the casting has been thoroughly cooled, since during the transition from a guiding system to another, a desintegration of the sand matrix, that is, of the formed accumulation, could lead to a quick, premature and uneven cooling of the castings. On the other hand the stripping of the flask from the sand matrix should not be delayed too much, since after the casting or melting operation the sand matrix is softened, it partially burns and looses rapidly its resistance as a whole so that the sand matrix cannot be transferred, surrounding the casting and together with it, of the other guiding system.

The invention has as its object to provide a method and a device for the moulding, melting and cooling of castings, which makes it possible, with a comparatively small first cost and with a small number of flasks, an unperturbed cooling of the castings.

This object is achieved in a method for the production of castings with moulding, melting and stripping of the matrix on a rotary guide by means of flasks, according to the invention, by the fact that subsequently to melting and the initial cooling of the castings, the flasks are stripped from the sand matrices, the flasks are directly sent to the moulding machine and the sand matrices with the castings, without being displaced, are further conveyed for an additional cooling on the same rotary guide. In a particularly advantageous way, the sand matrix and the casting are removed from the guide just immediately before the moulding station, that is, the station at which the cores are inserted.

The approach according to the invention has the advantage that, with a small first cost and a small number of flasks, the separation of the casting from the sand matrix takes place a long time after the melting of the casting and the entire guide is exploited for the cooling step.

The invention affords the further advantage that the flasks are stripped from the sand matrix at the point where they are conveyed along the shorter route to the new use. The approach according to the invention has the additional advantage that a disintegration of the mould is avoided until the casting has been cooled enough, since the sand matrix does not undergo any change in the conveyance system of the conveyor as such, but stays on the guide, that is, on the dolly or the platform of the system which carries the sand matrix since the start of the conveyance.

In a further embodiment of the invention, it is suggested that the flasks are stripped from the sand matrices at a point away of the moulding station. In this manner the result is achieved that the flasks can be directly employed again along the shortest route.

A device which is particularly advantageous for reducing the method into practice with a rotary guide in the shape of a loop with two guide sections extended in a spaced apart relationship, which are connected to one another at their respective ends by arcs of a circle, is characterized in that the station which is positioned at the straight guide section for stripping the flasks from their sand matrices, is opposite to the station for moulding the castings (moulding station).

In yet another embodiment of the invention, in the space between the flask moulding station and the confronting guide the moulding machine is provided. In this case the further approach according to the invention is practicable due to the fact that in a flask stripping station, the upper flask and the lower flask are stripped from the sand matrix and in the space between the moulding station and the opposite pathway, a moulding machine is arranged, which alternately moulds the upper and the lower flasks and places the lower flask and the upper flask on the guide at a mutual spatial distance.

In a further embodiment of the invention it is suggested that in the direction of travel of the casting on the guide, the guide section for melting and cooling the castings inside the flasks is dimensioned shorter than the guide section for cooling the castings in the sand matrix stripped of its flasks.

Another suggestion of the invention lies in that in the cooling route the unmoulding station for the upper flask and the lower flask are spaced apart from one another and the stripping station for the upper flask is associated to a moulding machine for said upper flask, and the stripping station for the lower flask is associated to a moulding machine for the lower flask itself in the space between the cooling route and the moulding route.

The invention will be explained in more detail in the accompanying drawing on the basis of two embodiments thereof. It is not restricted to the illustrated embodiments, but further modifications are practicable within the scope of the invention.

Figure 1:
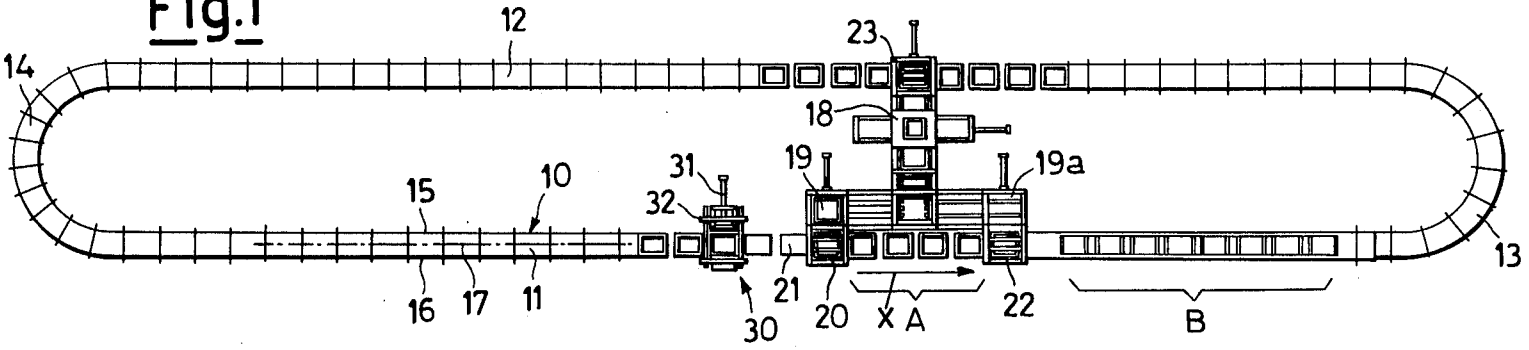
FIG. 1 shows an installation for moulding, melting and cooling, in top plan view.

The installation is composed by a closed-loop rotary guide 10, made up by two straight guide sections 11 and 12, spaced apart from one another and extended parallely to one another, which are connected at their respective ends by semicircular sections 13 and 14. The rotary guide can be composed by conveyance system of different kinds. Thus, rails 15 and 16 can be provided, on which hooked-in dollies are allowed to roll, which carry the flasks with the sand matrices. Also roller conveying paths can be used. Lastly, it is also possible to have linked plates or platforms to travel, which are connected to each other by a conveying chain 17 or different members of this kind. Lastly, other systems or structures can be used, which are conventional or adapted to the rotary or circulatory conveyance of flasks or foundry moulds.

It should be noted, lastly, that the moulding installation embodied as a rotary or circulatory guide does not necessarily exhibit a symmetrical outline as viewed in the accompanying drawing. Particularly advantageous, however, are the guide sections 11 and 12 which extend parallely to one another and are connected at their end by semicircular sections 14 and 15.

In the space between the straight guide sections 11 and 12, parallel to and spaced apart from, one another, a moulding machine 18 is provided, which, in the example shown, is so shaped that it alternately moulds an upper flask and a lower flask. The moulding machine 18 is associated to two dumping machines 19 and 19*a,* the dumper 19*a* being advantageously provided only to process the upper flask with the casting system, that is, to clean the upper flask. In a particularly advantageous arrangement, dumping machines are provided at both sides of the moulding machine.

The dumper 19 deposits the lower flask 20 on a conveying unit of the guide 11 and thus in a particularly advantageous manner on a dolly 21 of the guideway. After that the lower flask has been deposited on the guide, the guide is caused to go on intermittently along a step which corresponds to the distance between two dollies on the guide. The guide can also be driven continually at a correspondingly low speed, the continuous motion being preferable. The dumper 19*a,* which deposits the upper flask 22, is arranged at a distance with respect to the machine 19 in the direction of the arrow X of the direction of advance of the guide, so that between the two dumping machines for depositing the core flasks, the core-inserting path finds its place. After that, then, in the lower flasks which are in the core-inserting path A, the cores have been inserted, the upper flasks are deposited as well as the lower flasks.

Figure 3:
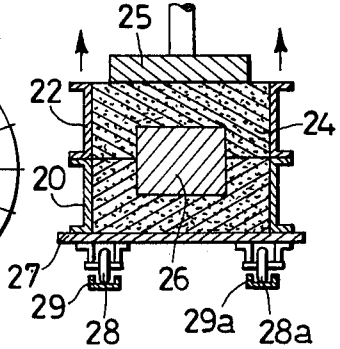
FIG. 3 shows a vertical cross-sectional view taken through the flask-stripping device.

Past the path A there is the melting or casting route B on which molten metal is poured in the mould. Past it, there is the cooling path which is extended, the aforementioned core insertion path and casting path excepted, along the entire length. In the stripping station 23 the upper flask and the lower flask are stripped from the sand mould, that is from the mass which has been formed. This stage takes place, for example, according to the manner which has been diagrammatically shown in FIG. 3, so that on the sand mould 24 there is placed a mould 25 and the upper flask 22 as well as the lower flask 20 are lifted in the direction of the indicated arrow, whereas the sand mould 24 with the casting held therein, 26, rests on the plate carrying it, 27, which slides by means of wheels 28, 28*a,* on rails 29, 29*a.* After that both the flasks have been stripped from the sand mould by unmoulding towards the top, they are carried to the moulding machine 18. The flask stripping station is thus a structural part of the moulding machine, since the stripping of the flask and their conveyance towards the moulding machine takes place by means of a constructional connection unit which is an attachment to said machine.

The sand moulds, that is, the sand heaps with the castings held therein are further advanced on the guide so that they start a long travel for their cooling and only immediately before the point at which the lower flasks filled with the forming material are laid on the guide. In the ejection zone, indicated at 30 in FIG. 1, the sand moulds are ejected with the castings from the guideway. According to the selected embodiment, this takes place by the agency of a hydraulic, or pneumatic, ram 31 with an ejection plate 32.

Figure 2:
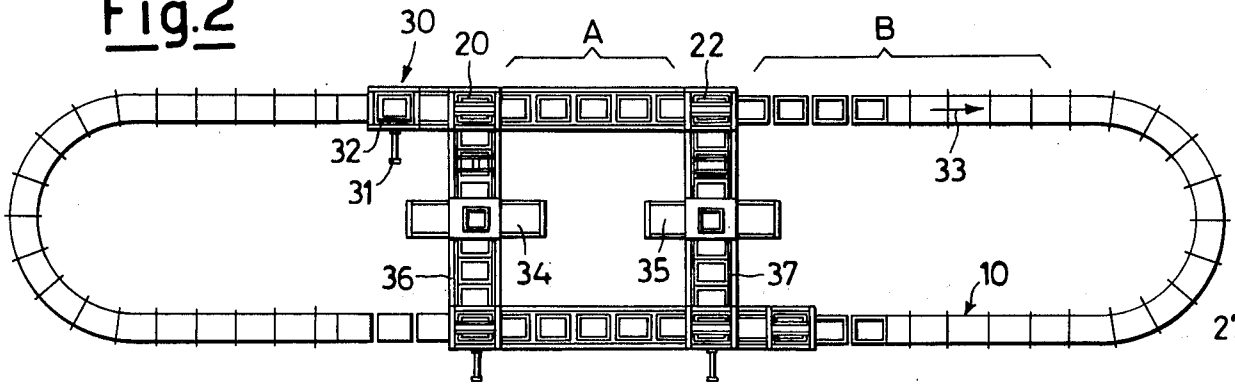
FIG. 2 shows an installation which is modified relative to that of FIG. 1.

FIG. 2 shows a modification in the sense that the guiding system which is circulated in the direction of the arrow 33, has two moulding machines 34 and 35, the moulding machine 34 forming the lower flask 20. The core-insertion path has likewise been indicated by the letter A. The upper flasks 22, formed by the moulding machine 35, are laid on the lower flasks equipped with the cores. At B, the casting route has likewise been indicated.

As soon as the mould with both flasks, during its motion on the guide, reaches the area of the moulding machine 35, then it is unmoulded therein the upper flask, which is led to the moulding machine 35, which is likewise equipped, with advantage, with a dumping device for cleaning the upper flasks. The lower flask with the moulding sand, on the moulding sand initially arranged on the upper flask, is further advanced until the mould reaches the moulding machine 34. In the area of the latter, the lower flask 20 is stripped from the sand mould and directly led, or through the shortest path, to the moulding machine 34. FIG. 2 shows that on the leading guides 36 and 37 to the moulding machines, which extend at right angles relative to the rectilinear section of the guide, there are arranged a number of flasks in waiting position, which are fed, however, in a continuous manner to be filled by the moulding machine. The two moulding machines 34 and 35 are equipped in a particularly advantageous manner for the quick change of the plates.

The sand moulds, clear of the flasks, are further advanced with the castings on the guide, until they reach an adjoining area wherein a new lower flask is deposited on the guide. By the ejection arrangement 31 and 32, the sand mould and the casting are ejected from the belt 10.

While FIG. 2 has shown the arrangement of two moulding machines 34 and 35 in the centre of a loop guide, it is possible in many cases to shape the guide section for cooling the casting in the mould with the flasks so as to have a shorter guide, or, stated another way, the section shown at the right in FIG. 2, can be maintained shorter that the section shown at the left. By such an expedient the result is that fewer flasks are required.

The approach according to the invention, with the expedient of carrying out during the longest possible time the cooling on the same guide and separating, after the shorter possible time the flasks from the sand moulds and of leading the same sand mould on the same guide, considerably reduces the first cost of the installation. It is necessary, furthermore, to have a comparatively reduced number of flasks. A saving of core binders can also be achieved, since the sand moulds, for a sufficient cooling of the casting, are not transferred to another guiding system and thus are not subjected to strong mechanical strains and are thus required to have a lesser robustness.

Obviously, the approach according to the invention can be carried out with different materials as usual in the foundry technology for effecting the castings. The moulding material can thus be either a natural or a synthetic material. It can be bound by clay but also by a resin. It is also possible, lastly, to use moulds in which no core insertion is necessary so that the core insertion paths A can be dispensed with, which can be seen in the drawings. In this way, the guide on which the sand moulds can be cooled without being surrounded by the flasks with the castings held therein, can be extended.

I claim:

1. An apparatus for producing castings, comprising a conveyor arranged in a closed loop having at least two laterally adjacent straight sections spaced along the closed loop, at least one moulding machine located adjacent said conveyor between said straight sections adapted to form sand moulds within flasks, at least one flask loading device located adjacent a first one of said straight sections of said conveyor including means to receive mould filled flasks from the moulding machine and to load them on said conveyor, at least one flask stripping device located adjacent a second one of said straight sections of said conveyor including means to strip the flasks from the respective moulds and to transfer them to said moulding machine, a metal pouring device located adjacent said conveyor immediately downstream from said loading device in a first conveyor path from said loading device to said stripping device and a mould discharging device located adjacent said conveyor immediately upstream of said loading device in a second conveyor path from said stripping device to said loading device.

2. An apparatus according to claim 1, wherein said first conveyor path is shorter than said second conveyor path.

3. An apparatus according to claim 1, wherein said closed loop comprises said straight sections and two substantially semicircular sections interconnecting said straight sections at their ends.

4. An apparatus according to claim 1, wherein said loading device and said stripping device are associated to said straight sections of the conveyor so as to be faced to one another with said moulding machine interposed therebetween.

5. An apparatus according to claim 1, which comprises one moulding machine for filling upper and lower flasks and two flask loading machines for respectively loading said upper and lower flasks on respective first and second areas of said first straight section of said conveyor, said first area being located downstream of said second area.

6. An apparatus according to claim 1, which comprises two moulding machines for respectively filling upper and lower flasks, two flask loading machines mounted for respectively loading said upper and lower flasks on respective first and second areas of said first straight section of said conveyor and two flask stripping devices located adjacent respective first and second areas of said second straight section of said conveyor for respectively stripping upper and lower flasks from the moulds, said first area of said first straight section being located downstream of said second area of said first straight section and said first area of said second straight section being located upstream of said second area of said second straight section.

* * * * *